US010060128B2

(12) United States Patent
Ander et al.

(10) Patent No.: US 10,060,128 B2
(45) Date of Patent: Aug. 28, 2018

(54) MULLION-TRANSOM STRUCTURE

(71) Applicant: SCHUECO INTERNATIONAL KG, Bielefeld (DE)

(72) Inventors: Emal Ander, Bad Salzuflen (DE); Peter Molitor, Steinhagen (DE); Andre Stockhausen, Herford (DE)

(73) Assignee: SCHUECO INTERNATIONAL KG, Bielefeld (DE)

( * ) Notice: Subject to any disclaimer, the term of this patent is extended or adjusted under 35 U.S.C. 154(b) by 0 days.

(21) Appl. No.: 15/543,349

(22) PCT Filed: Dec. 29, 2015

(86) PCT No.: PCT/EP2015/081364
§ 371 (c)(1),
(2) Date: Jul. 13, 2017

(87) PCT Pub. No.: WO2016/113109
PCT Pub. Date: Jul. 21, 2016

(65) Prior Publication Data

US 2018/0023295 A1 Jan. 25, 2018

(30) Foreign Application Priority Data

Jan. 4, 2015 (DE) ..... 10 2015 100 524

(51) Int. Cl.
*E04B 2/96* (2006.01)

(52) U.S. Cl.
CPC ..... *E04B 2/96* (2013.01); *E04B 2/965* (2013.01); *E04B 2/967* (2013.01)

(58) Field of Classification Search
CPC ... E04D 2003/0806; E04B 2/967; E04B 2/96; E04B 2/965; E04B 2/962
See application file for complete search history.

(56) References Cited

U.S. PATENT DOCUMENTS

| | | | | |
|---|---|---|---|---|
| 3,367,077 A | | 2/1968 | Johnston | |
| 3,466,826 A | | 9/1969 | Gallagher | |
| 3,956,863 A | * | 5/1976 | Tiedeken | E06B 3/68 49/504 |

(Continued)

FOREIGN PATENT DOCUMENTS

| | | |
|---|---|---|
| DE | 1 191 537 | 4/1965 |
| DE | 30 48 152 | 6/1982 |

(Continued)

*Primary Examiner* — Brian D Mattei
*Assistant Examiner* — Daniel J Kenny
(74) *Attorney, Agent, or Firm* — Collard & Roe, P.C.

(57) ABSTRACT

A mullion-transom structure includes a support profile upon which two grooves are provided on one side. A sealing strip is fixed on each of grooves. A filling element is held at an edge on each of the sealing strips and a middle groove, on which at least one fastener for holding a pressure strip is fixed, secures the two filling elements. The middle groove has groove walls that are accommodated between the sealing strips. A contact plane of the filling elements on the sealing strips is arranged closer to the pressure strip than the groove walls of the middle groove. The middle groove has a groove base, at which a hollow chamber is formed on the side facing away from the groove.

9 Claims, 11 Drawing Sheets

(56) References Cited

U.S. PATENT DOCUMENTS

| | | | | | |
|---|---|---|---|---|---|
| 4,557,089 | A | * | 12/1985 | Breithaupt | E04B 2/92 52/235 |
| 4,590,725 | A | * | 5/1986 | Kaminaga | E04B 2/90 52/204.591 |
| 6,141,923 | A | * | 11/2000 | Habicht | E04B 1/943 52/232 |
| 7,080,488 | B2 | * | 7/2006 | Hocker | E04B 2/965 52/200 |

FOREIGN PATENT DOCUMENTS

| | | |
|---|---|---|
| DE | 37 35 016 | 10/1988 |
| DE | 38 12 223 | 11/1989 |
| DE | 90 02 092 | 4/1990 |
| DE | 41 05 208 | 8/1992 |
| DE | 203 18 083 | 2/2004 |
| EP | 0 652 335 | 5/1995 |
| EP | 1 329 566 | 7/2003 |
| EP | 1 346 114 | 9/2003 |
| EP | 2 532 801 | 12/2012 |
| EP | 2 787 138 | 10/2014 |
| GB | 2 143 558 | 2/1985 |
| WO | WO 2005/035901 | 4/2005 |

* cited by examiner 1
1'
1"
2
4
4'
4"
15
15'
16
25
40
41
42
43
43'
44
45

MULLION-TRANSOM STRUCTURE

CROSS-REFERENCE TO A RELATED APPLICATION

The invention described and claimed hereinbelow is a National Stage Application of PCT/EP2015/081364, filed on Dec. 29, 2015 (the PCT application), now filed in the United States under 35 USC § 371. The PCT application claims priority from German Patent Application DE 10 2015 100 524.7, filed on Jan. 14, 2015. The contents of the PCT application and the German Patent Application are incorporated by reference herein. The PCT application provides the basis for a claim for priority of invention.

BACKGROUND OF THE INVENTION

The present invention relates to a mullion-transom structure, comprising a support profile, on which two grooves are provided on one side, on each of which a sealing strip is fixed, wherein a filling element is held on the edge on each of the sealing strips, and a middle groove, on which at least one fastening means for holding a pressure strip is fixed, to secure the two filling elements by means of the pressure strip.

A mullion-transom structure is known from DE 203 180 83 U1, in which a middle screw channel is formed on each of the support profiles. A drainage groove is provided on both sides of the screw channel, and in addition a groove for drawing in a sealing strip is formed on opposite sides, to accommodate filling elements. The screw groove, which protrudes from the support profile, enables simple mounting of a pressure strip via screws, however, the thermal insulation is minor in the region of the groove walls of the screw groove. Moreover, the visible width of the support profile is comparatively broad due to the plurality of grooves on the outer side. DE 37 35 016 C1 also discloses a frame construction, in which the post profile has a screw groove, which extends up to between two insulation glass panes, which is disadvantageous for the thermal insulation.

DE 41 05 208 A1 discloses a building façade construction, in which a plurality of connector elements are secured on a groove on a support profile, which are used to mount a pressure strip, which is tensioned toward glazing elements. The support profile is designed as T-shaped in cross section and has grooves for seal profiles on both sides of the middle groove for the connector elements.

EP 1 329 566 A1 discloses a mullion-transom structure, in which the profiles have a middle screw channel on an outer side. Anchoring grooves for seals are provided on both sides of the screw channel. However, no additional hollow chamber within the profile is associated with the screw channel. Only grooves for introducing projections of a sealing collar are provided in a cavity of the profiles. A similar support profile having a middle screw groove is also disclosed in EP 2 787 138 A1.

OBJECTS AND SUMMARY OF THE INVENTION

It is therefore the object of the present invention to provide a mullion-transom structure, which has optimized thermal insulation and a compact structure.

According to the invention, the support profile has a middle groove having groove walls. These groove walls are accommodated between the sealing strips, wherein a contact plane of the filling elements on the sealing strips is arranged closer to the pressure strip than the groove walls of the middle groove. It is thus ensured that the groove walls, which usually consist of metal and are a good heat conductor, do not protrude into the intermediate space between the filling elements and thus ensure poor thermal insulation. Rather, the short formation of the groove walls, which are accommodated between the sealing strips, is advantageous for the thermal insulation, because the intermediate space between the filling elements can be readily theinially insulated by way of corresponding insulation elements.

The middle groove has a groove base, on which a hollow chamber is formed on the side facing away from the groove. This hollow chamber can be used for mounting further components, in particular, a groove block can be introduced into the hollow chamber. At least one inwardly oriented web can be provided at the hollow chamber for guiding the groove block. Additionally or alternatively, a wall of the hollow chamber, which is penetrated by a screw for fixing a component, can extend in parallel to and spaced apart from the groove base, so that the middle groove can assume a fastening function on the support profile in manifold ways. The hollow chamber arranged adjacent to the groove base preferably has substantially the same width as the groove in this case. This enables a particularly compact construction with a high level of thermal insulation.

For a particularly compact structure of the mullion-transom structure, the support profile additionally has a small width, wherein the width perpendicular to a longitudinal direction of the grooves on an outer side of the support profile is less than 50 mm, preferably less than 45 mm, in particular less than 38 mm, for example, approximately 35 mm. The support profile can therefore also be used for filigree mullion-transom structures. A high level of thermal insulation is obtained independently of the width of the support profiles, because the groove for accommodating the fastening means does not protrude into the contact plane of the filling elements. It is thus also possible to use the construction shown for particularly broad support profiles, for example, wider than 50 mm.

For the compact construction, the middle groove or a hollow chamber adjacent to the groove base of the middle groove is at least regionally a drainage channel for discharging penetrating water. Additional drainage grooves, which enlarge the width of the support profile, can thus be omitted. The middle groove or a hollow chamber adjacent to the groove base of the middle groove is alternately used for the drainage.

In a further embodiment of the invention, at least one glass carrier is hung or screwed on the middle groove. The middle groove can thus assume multiple functions, on the one hand, for fastening the fastening means and, on the other hand, for fastening the glass carrier, façade brackets, and further components and mounting elements.

For a drainage of the mullion-transom structure, a recess is preferably provided on the groove for a sealing strip, on which recess an end section of a further support profile is mounted, and a drainage channel of the further support profile discharges into the middle groove or into a hollow chamber adjacent to the groove base of the middle groove. Effective drainage can thus be performed, in particular if the further support profile, as a beam, discharges water penetrating into the support profile designed as a post.

For statically good support of the filling elements, at least one recess is preferably provided on a groove base on the middle groove of the vertical support profile, in which a hook of a glass carrier is hung. The glass carrier can, using one or more hooks, have a vertically aligned hanging part, on which a horizontally aligned supporting part is fixed, on which filling elements can at least partially rest. Alternatively, the glass carrier is only attached in the horizontal support profile or also on two horizontal support profiles, which are arranged adjacent to the vertical support profile.

In a further embodiment, a rib is formed on the support profile on a groove base of the middle groove.

BRIEF DESCRIPTION OF THE DRAWING FIGURES

The invention will be explained in greater detail hereafter on the basis of several exemplary embodiments with reference to the appended drawings. In the figures.

Figure 10:
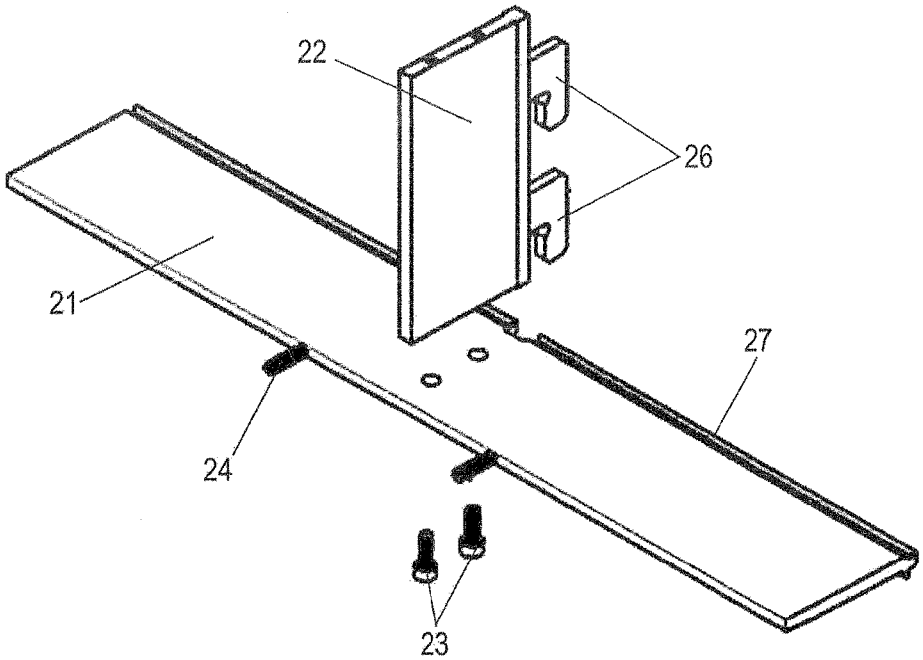
Figure 11:
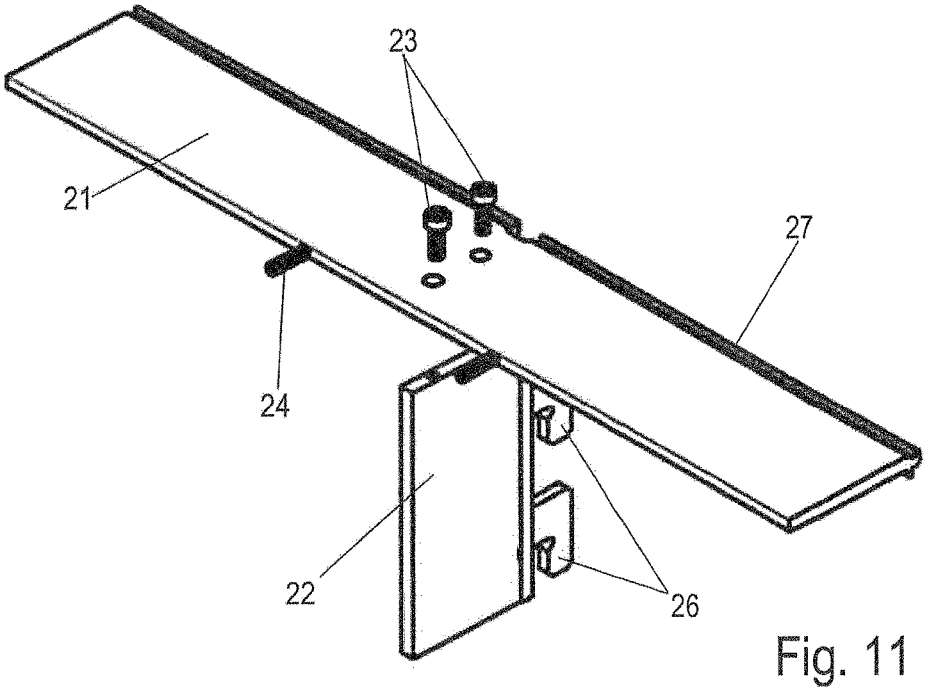
Figure 12B:
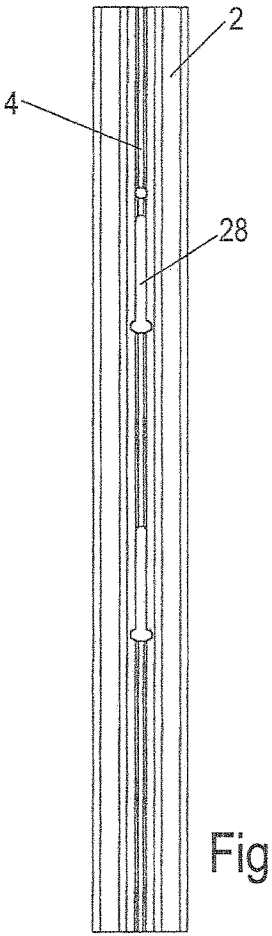
Figure 12A:
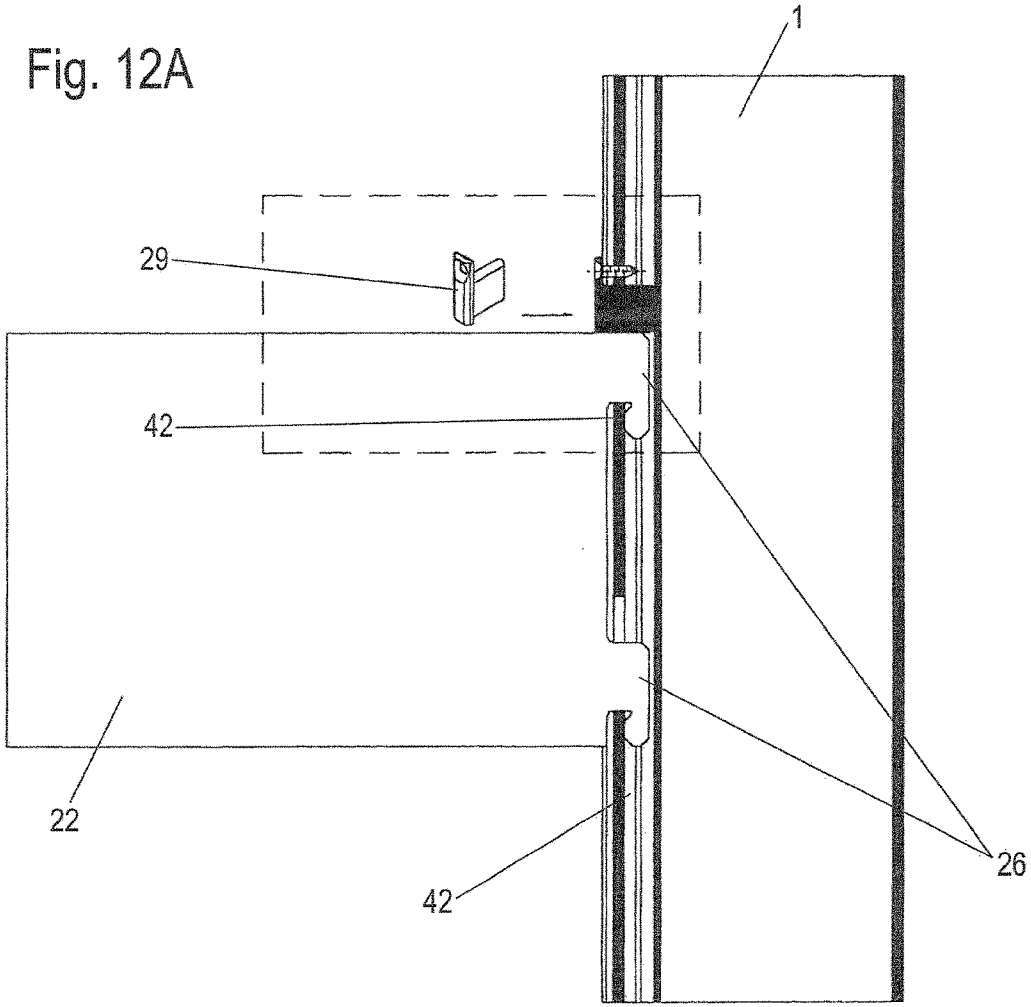
Figure 13:
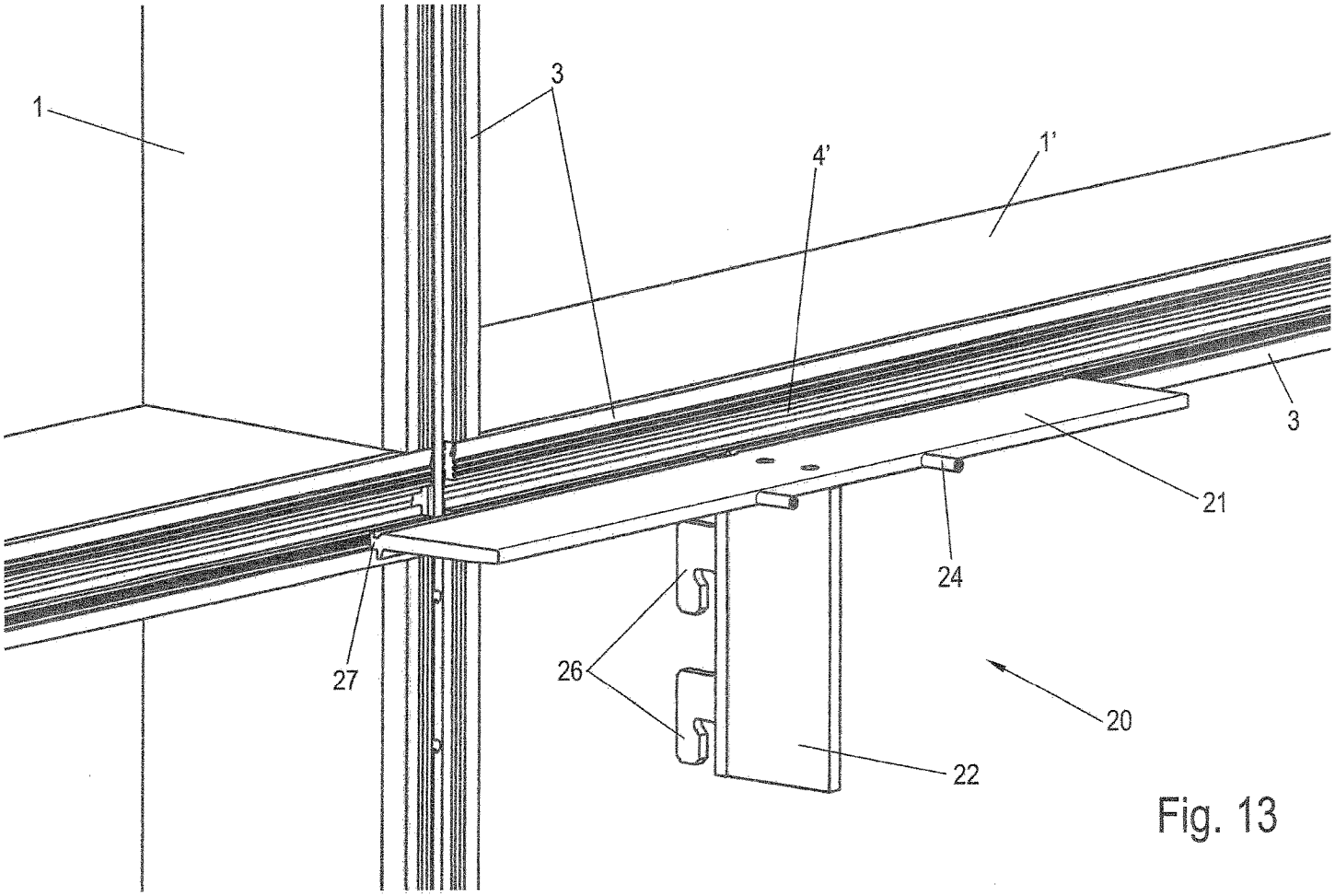

FIG. 10 presents a perspective exploded view of a glass carrier for a mullion-transom structure;

FIG. 11 presents another perspective exploded view of a glass carrier for a mullion-transom structure;

FIG. 12A presents a view of a hung glass carrier on a support profile;

FIG. 12B presents another view of a hung glass carrier on a support profile; and FIG. 13 presents a perspective view of the mullion-transom structure during the hanging of a glass carrier.

DETAILED DESCRIPTION OF THE INVENTION

The support profile 1 of a mullion-transom structure shown in FIG. 1, which is used in particular as a façade, skylight, or pitched roof, can be used as a substantially vertical post or substantially horizontal beam. The support profile 1 comprises two grooves 2 on an outer side, on each of which a sealing strip 3 is fixed. Furthermore, a middle groove 4 is provided between the two grooves 2, which is used for fastening a pressure strip 6, to fix a filling element 5 in a clamping manner between the sealing strips 3 and sealing strips 7 on the contact pressure profile 6.

The support profile 1 preferably consists of metal, in particular of aluminum, but can also consist of wood or plastic and if needed can also be formed in multiple parts, for example, having an attachment profile which is fixed on a bar. The support profile 1 can be formed as a hollow profile, in particular having a plurality of hollow chambers of different sizes. The filling elements 5 can be formed as insulating glass panes, but other plate-shaped elements can also be secured on the support profile 1.

A cover profile 8 is locked on the pressure strip 6 on the outer side, which has substantially the same width as the support profile 1 in a direction perpendicular to the longitudinal direction of the grooves 2.

For good thermal insulation, an insulation element 9 is arranged in the intermediate space between the end faces of the adjacent filling elements 5. The insulation element 9 comprises a web, which extends from the inner side from the support profile 1 to the outer side, wherein two perpendicularly protruding arms 90 extend from the web, which partially rest on an outer side of the filling elements 5. The web informed in multiple parts and comprises two plastic webs 91 made of a harder material, between which a softer filling material 92, in particular a foamed material having a higher level of thermal insulation, is provided. Projections 93, which protrude toward the end face of the filling elements 5, to increase the thermal insulation, are provided on the plastic webs 91 on the inner side adjacent to the support profile 1.

Figure 1A:
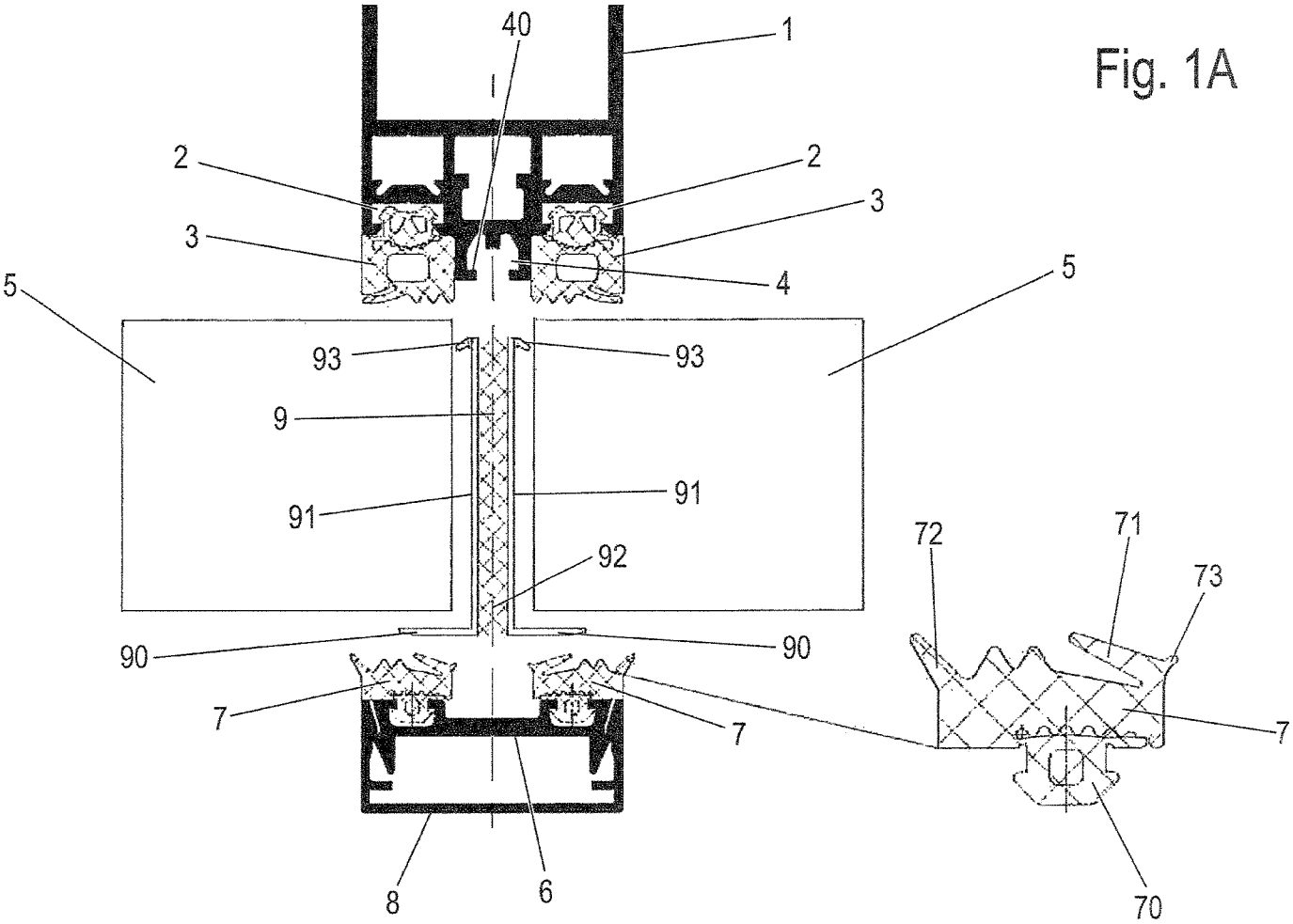
FIG. 1A depicts a sectional view through a mullion-transom structure, according to the invention.

In FIG. 1A, the profile of the sealing strip 7 is also visible in the detail view, which has a seal base anchored in the pressure strip 6, which is connected via a film hinge to a seal body, on which an outer sealing lip 72 and an inner sealing lip 71 are formed, wherein a drip edge 73 is provided on the inner sealing lip 71.

Figure 1B:
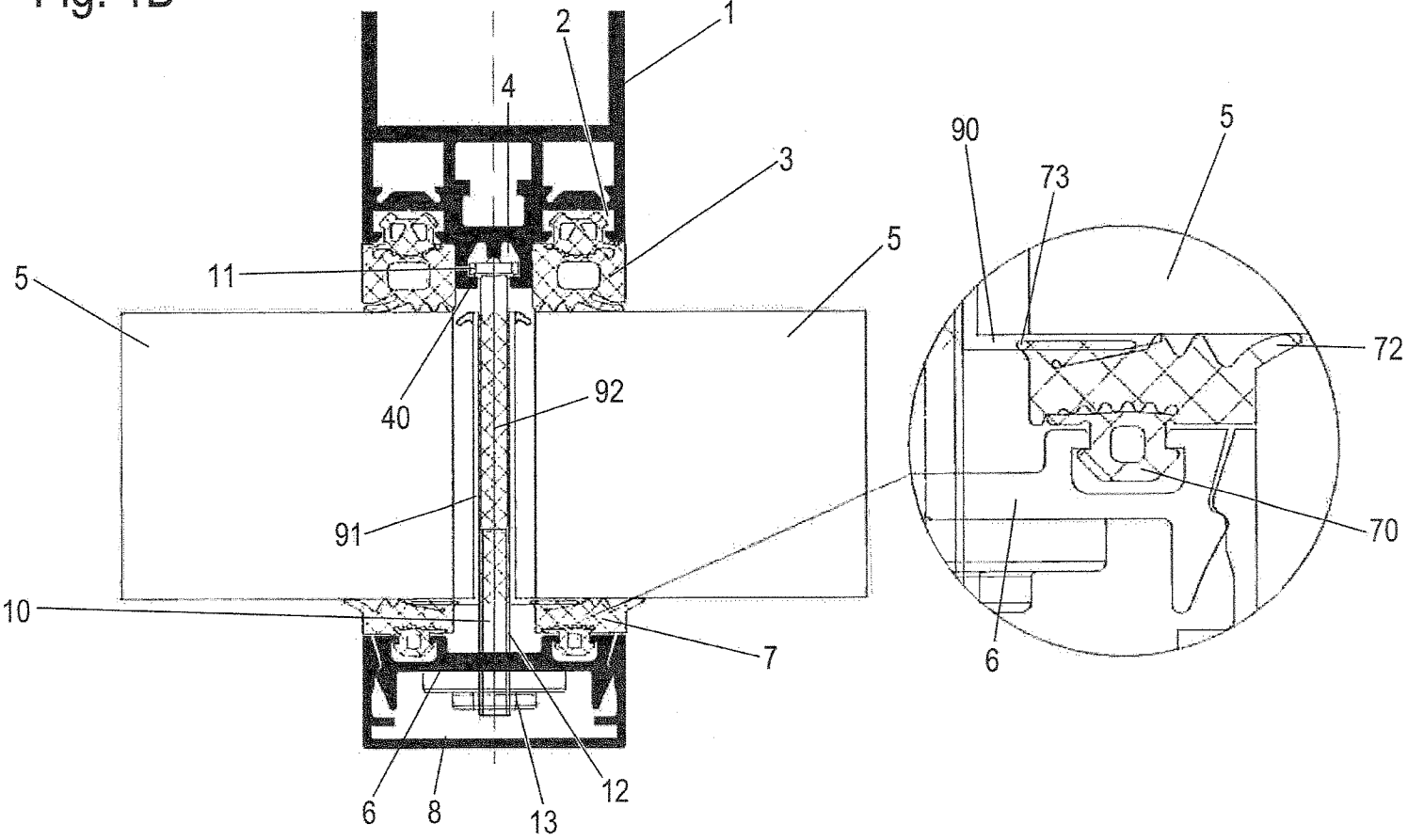
FIG. 1B depicts another sectional view through a mullion-transom structure, according to the inventions

In FIG. 1B, the mounted position of the support profile 1 is shown. A head section 11 of a fastening means 10 is introduced at the middle groove 4, wherein inwardly protruding webs 40 engage behind the head section 11 and therefore the fastening means 10 is secured against pulling out. The fastening means 10 can be displaceable with the head section 11 along the middle groove 4 during the mounting and is then fixed by the clamping forces when a nut 13 is screwed onto the outer side on a threaded section 12 of the fastening means, to fix the pressure strip 6 in a clamping manner. A bolt of the fastening means 10 penetrates the softer filling material 92 in this case and is accommodated in the plastic webs 91. The sealing strip 7 rests on an arm 90 of the insulation element 9 and presses it against the outer side of the filling element 5.

Figure 2:
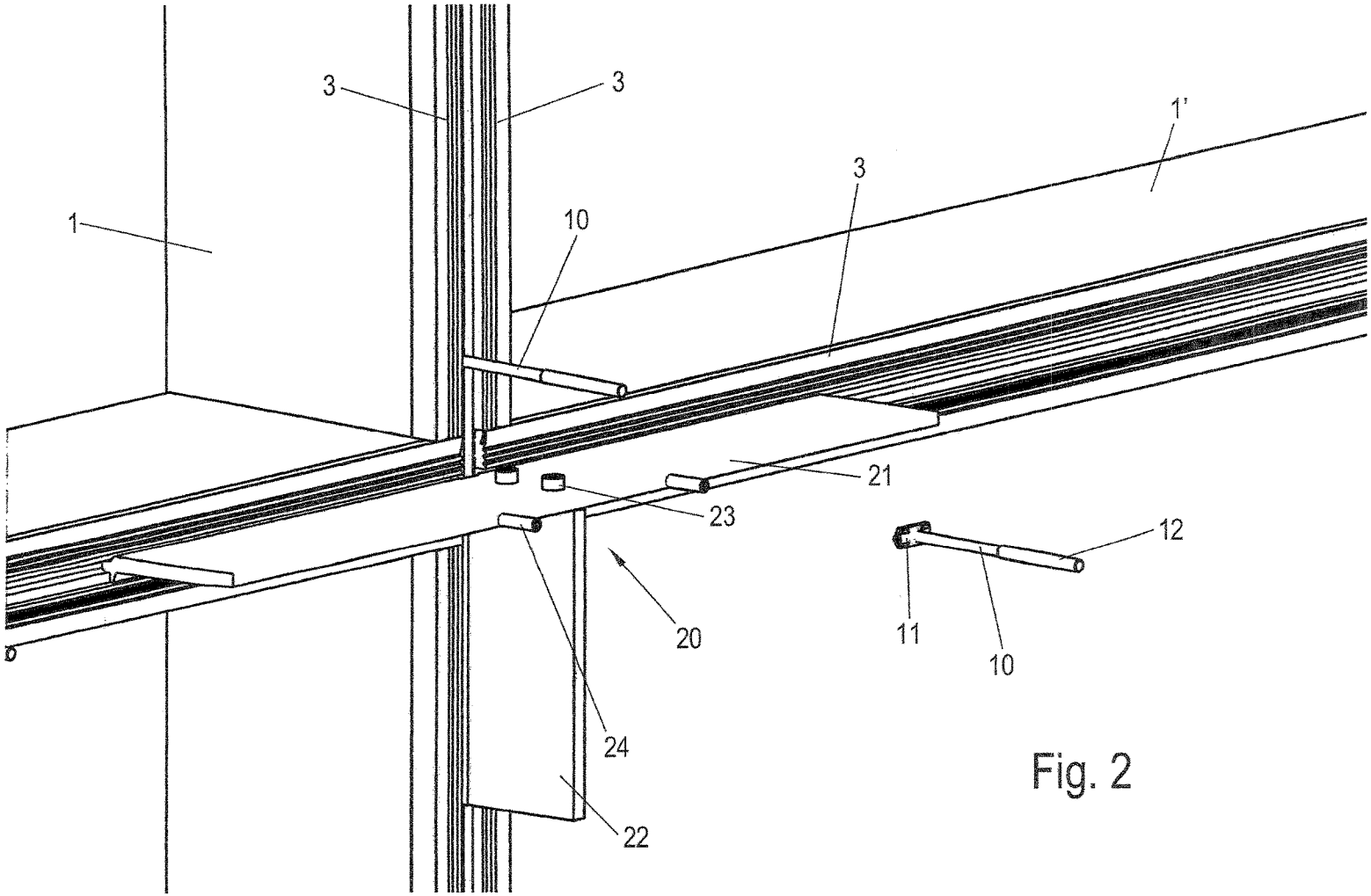
FIG. 2 depicts a one of multiple views of the mullion-transom structure of FIG. 1, during a mounting.

In FIG. 2, a mounting position of the mullion-transom structure is shown, in which a vertical support profile 1 is connected to a further horizontal support profile 1'. Fastening means 10 are fixed on the two support profiles 1 and 1', which are inserted with a substantially cuboid or strip-shaped head section 11 into the middle groove 4 of the support profile 1 or 1', wherein corresponding recesses can be provided for this purpose on the middle groove 4, at which the inwardly protruding webs 40 are cut off.

In an intersection region of the support profiles 1 and 1', a glass carrier 20 is provided, which has a horizontal supporting part 21 and a vertical hanging part 22. The hanging part 22 and the supporting part 21 are fixed on one another by screws 23. Threaded sections 24 protrude on the supporting part 21 on which a nut 13 can be secured to fix a pressure strip 6.

Figure 3:
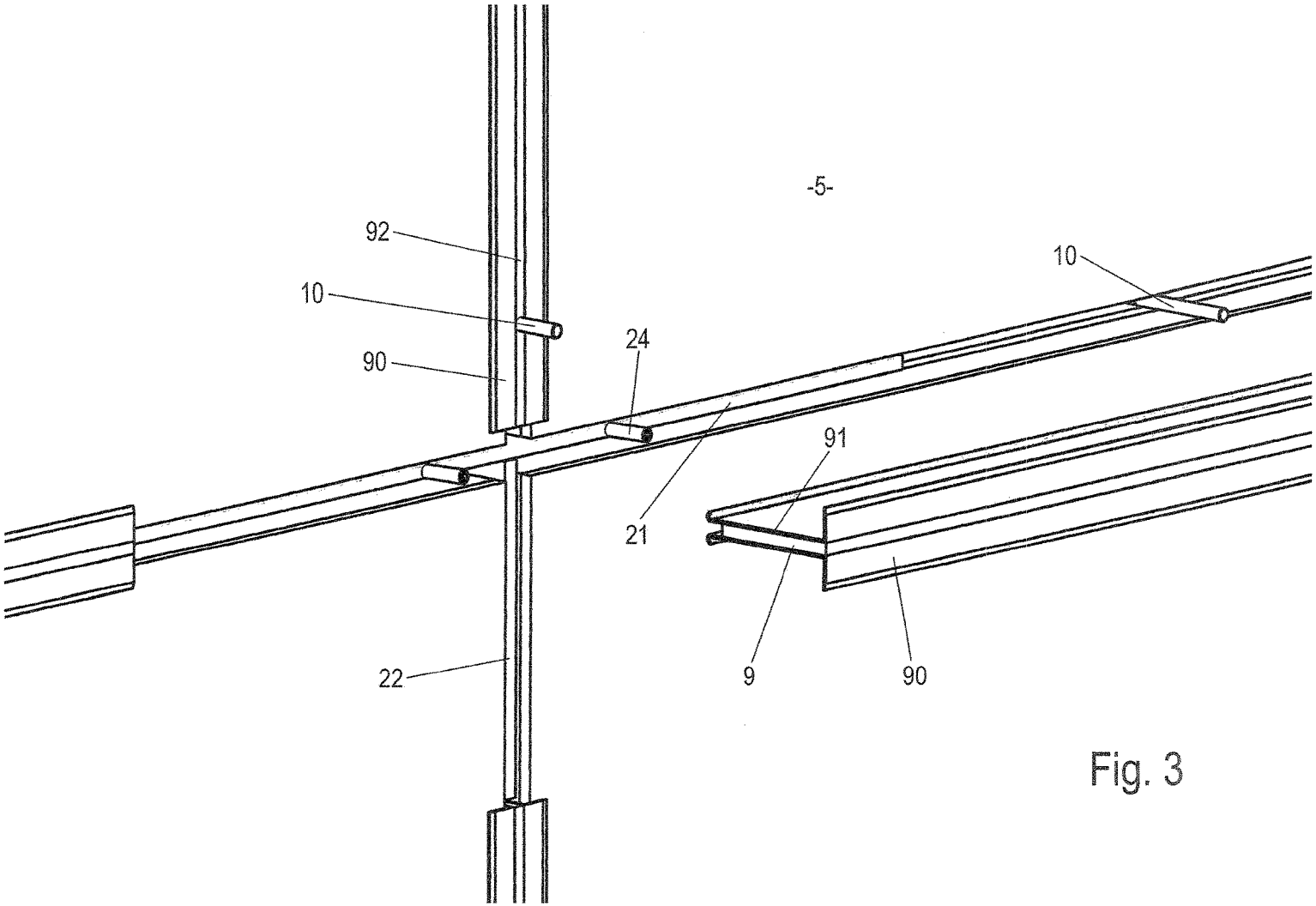
FIG. 3 depicts another one of multiple views of the mullion-transom structure of FIG. 1, during the mounting.
Figure 4:
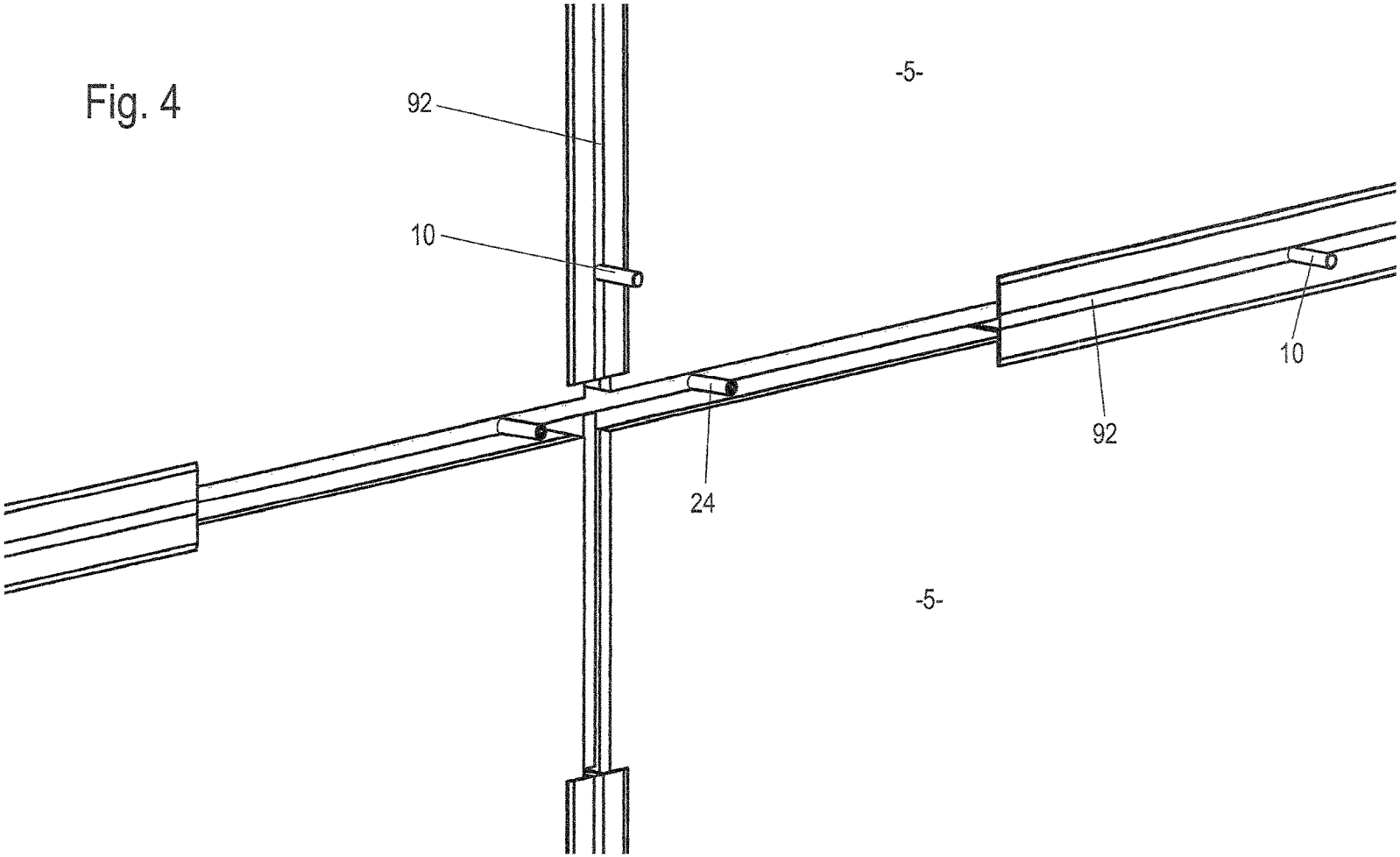
FIG. 4 depicts another one of multiple views of the mullion-transom structure of FIG. 1, during the mounting.

FIG. 3 shows that filling elements 5, in particular insulation glass panes, have already been applied to the sealing strips 3. In addition, insulation elements 9 have been inserted between each two adjacent filling elements 5, through which only the fastening means 10 pass, wherein a threaded section of the fastening means 10 protrudes outward. The upper filling elements 5 can be regionally supported directly or indirectly on the supporting part 21 of the glass carrier 20 in this case. In FIG. 4, the insulation element 9 was also plugged onto the fastening means 10, wherein the bolts of the fastening means 10 engage through the filling material 92. The bolts of the fastening means can be jacketed using an elastic insulating material to avoid the glass-metal contact.

Figure 5:
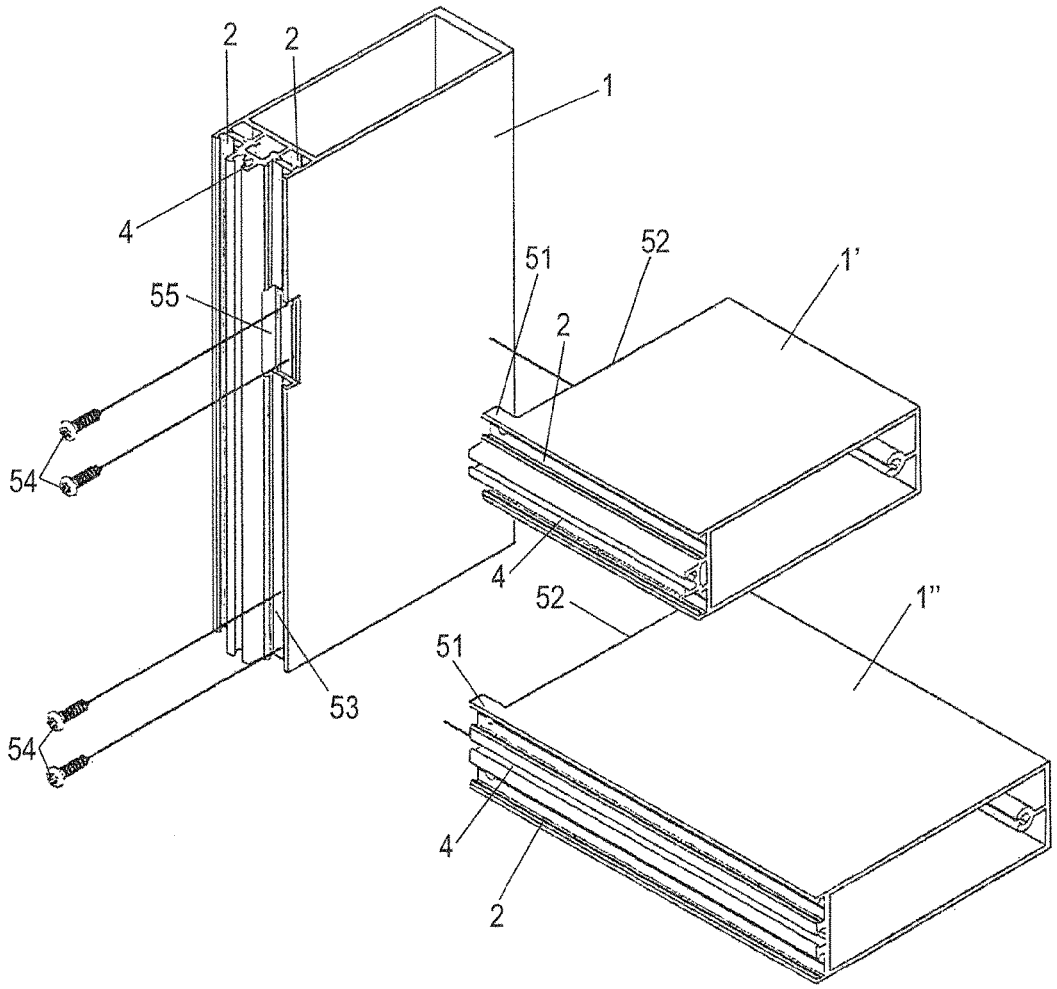
FIG. 5 depicts a perspective view of connection points of support profiles of the mullion-transom structure of FIG. 1.
Figure 6A:
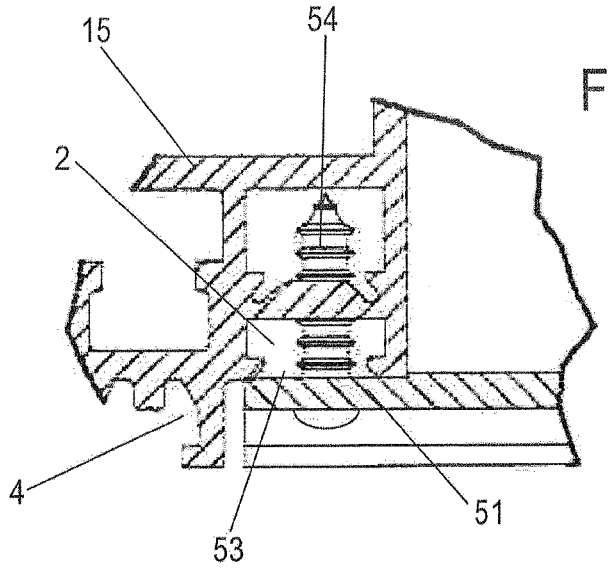
FIG. 6A depicts a detail view of the mounted connection points of FIG. 5.

In FIG. 5, the mullion-transom structure is shown comprising a vertical post and two support profiles 1' and 1" mounted spaced apart on the vertical support profile 1. The lower support profile 1" has two edge grooves 2 and a middle groove 4 on an outer side. The grooves 2 and 4 extend beyond a recess 52, so that an end section 51 having the grooves 2 and 4 protrudes. This end section 51 can be fixed on a support surface 53 at a lateral groove 2 of the vertical support profile 1, wherein boreholes are provided for this purpose on the end section 51, into which screws 54 are inserted. The fixing of the end section 51 is shown in FIG. 6A. The screw 54 penetrates the groove base of the groove 2, and the end section 51 rests on the groove walls of the groove 2. A drainage from the support profile 1" occurs such that the middle groove 4 on the support profile 1" and the rebate between the end faces of the filling elements 5 is used for drainage and any possible water can move from the region of the middle groove 4 on the support profile 1" to the middle groove 4 on the vertical support profile 1.

The upper horizontal support profile 1' is fastened in another way on the vertical support profile 1. On the support profile 1', the region of the grooves 2 and 4 at the end section 51 is extended, since the support profile 1' is provided with a cuboid recess 52. However, the end section 51 is not laid on the lateral groove 2, but rather a recess 50 is also provided on the vertical support profile 1, at which an opening 55 to a hollow chamber 43 is produced. In this way, it is possible to perform drainage into the hollow chamber 43, which is arranged adjacent to the groove base of the groove 4, in the case of a support profile 1'.

Figures 7, 8, 9:
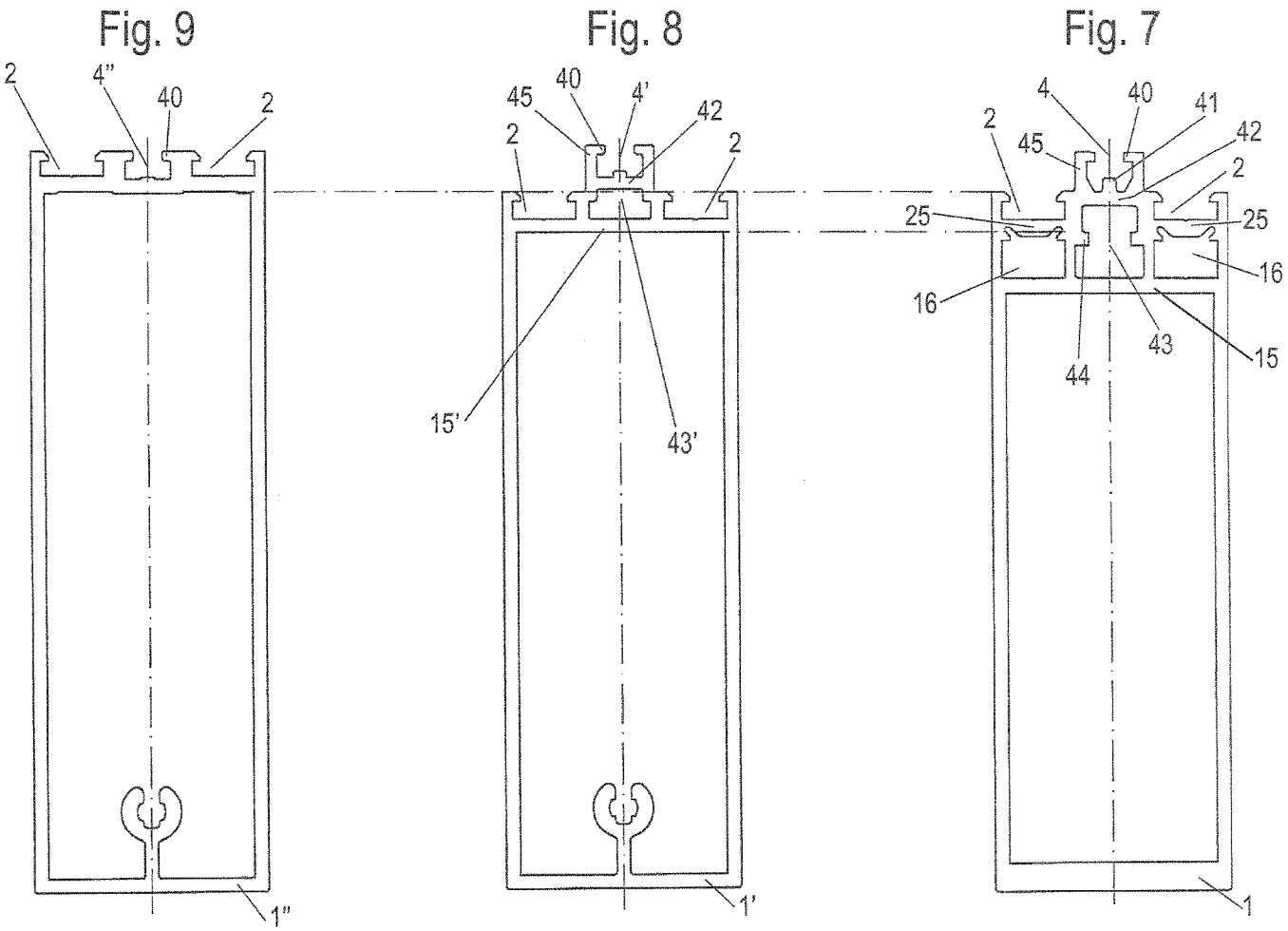
FIG. 7 depicts a sectional view of a support profile.
FIG. 8 depicts another sectional view of another support profile.
FIG. 9 depicts another sectional view of another support profile.

In FIG. 7, the support profile 1 is shown in cross section. The support profile 1 comprises a groove base 25, under which a hollow chamber 16 is provided, on each of the grooves 2. The hollow chamber 16 has approximately the same width as the adjacent groove 2. In the middle groove 4, the inwardly oriented webs 40 can be seen, which engage behind the head section 11. Furthermore, an upwardly protruding rib 41 is formed in the groove 4 at a groove base 42, on which the head section 11 can be supported and/or guided. The head section 11 can be pivoted about the rib 41 in a certain range or fixed in a clamping manner. The groove walls 45 of the groove 4 do protrude further toward an outer side than the groove walls of the grooves 2, however, they are still always accommodated in the mounted position between the sealing strips 3, which are arranged still further toward the outer side with the contact plane of the filling elements 5. Toward the inner side, a hollow chamber 43 is formed on the side opposite to the groove 4 at the groove base 42, in which inwardly oriented webs 44 are provided for guiding groove blocks. Furthermore, the hollow chamber 43 can be used as a drainage channel, as described above. The hollow chambers 16 and 43 are delimited by a wall 15, which extends parallel to the groove bases 25 and 43. The wall 15 connects to side walls of the support profile 1 in a middle region in this case, so that hollow chambers are formed on both sides of the wall 15. The wall 15 is arranged in this case in the cavity formed by the support profile.

Figure 6B:
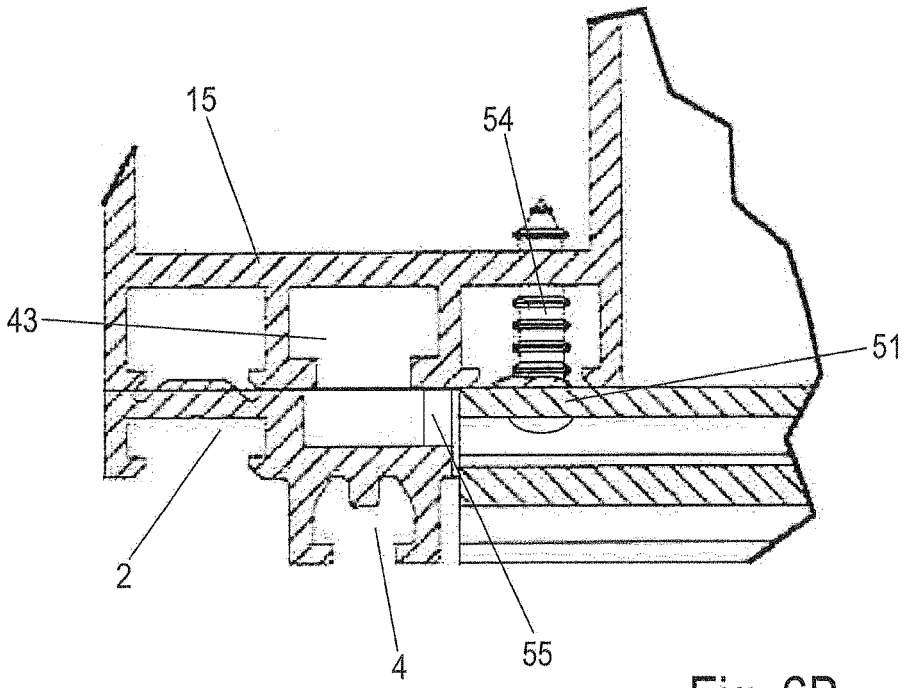
FIG. 6B depicts another detail view of the mounted connection points of FIG. 5.

The wall 15 can be used for mounting fastening means, as shown in FIG. 6B, in which the end section 51 is fixed by screws 54 on the wall 15.

The hollow chamber 43 and also the hollow chamber 43' are used to accommodate groove blocks, which are in turn used as counter bearings or as the groove block having threaded borehole for accommodating fastening means. These counter bearings are formed corresponding to the groove contour, the length and the material thereof can vary in accordance with the static requirements.

In FIG. 8, the support profile 1' is shown in detail, which can be used as a beam or as a replacement, for example. The support profile 1' has a similar structure in the region of the grooves 2 and 4' as the support profile 1, however, the hollow chamber 16 and the wall 15 are absent. The hollow chamber 43' is formed smaller and has a wall 15' or is delimited thereby, wherein the wall 15' forms the groove base in the region of the grooves 2. The groove 4' also has inwardly protruding webs 40 and is formed undercut.

In FIG. 9, the support profile 1" is shown in cross section, which has two outer grooves 2 and a middle groove 4" on the outer side. The grooves 2 and 4" have approximately equal depth in this case, wherein all grooves 2 and 4" are formed undercut, as can be seen by the inwardly oriented webs 40 on the groove 4". However, the support profile 1" does not have a hollow chamber adjacent to the groove base, which is associated with the grooves 2 and 4".

The support profiles 1' and 1" can be used vertically and also horizontally, support profile 1' can be fixed, like support profile 1", on the support profile 1.

In FIG. 10, a glass holder 20 is shown, as can be secured on a post beam construction. The glass holder 20 comprises a hanging part 22 and a supporting part 21, wherein the plate-shaped and vertically aligned hanging part 22 has two hooks 26 on the side facing toward the support profile. The supporting part 21 has a hanging contour 27 on the side facing toward the horizontal support profiles, for example, having a hook and a stop, so that it is possible for the supporting part 21 to pivot in at a middle groove 4, 4', or 4". Two threaded sections 24 protrude at the supporting part 21, which are used for mounting a pressure strip 6. In the exemplary embodiment shown in FIG. 10, the hanging part 22 is arranged above the supporting part 21 and is fixed via screws 23, which are screwed in from the lower side of the supporting part 21.

In FIG. 10, firstly the hanging contour 27 of the supporting part 21 is pivoted into the middle groove 4, 4', or 4". The hanging part 22 is subsequently fastened from above in the middle groove of the vertical support profile 1.

Alternatively, according to FIG. 11, the hanging part 22 can firstly be fixed in the middle groove 4, 4', or 4" of the vertical support profile 1. The hanging contour 27 of the supporting part 21 is then pivoted in and fixed on the hanging part 22.

It is also possible to arrange the hanging part 22 below the supporting part 21, as shown in FIG. 11. The hanging part 22 is then screwed together with the supporting part 21 via screws 23, which are screwed from an upper side into the supporting part 21.

In FIGS. 12A and 12B, the hanging part 22 is shown in a mounted position, in which the hooks 26 are introduced into slots 28 on the groove base 42 and at least partially engage behind the groove base 42. The hanging part 22 is thus easy to mount. The hanging part 22 can be secured in this case via a securing element 29, which is screwed onto the groove 4 and prevents lifting off of the hanging part 22. Alternatively, the hanging part 22 can be secured by the supporting part 21.

In FIG. 13, the glass carrier 20 is shown during the mounting of a mullion-transom structure. The supporting part 21 is pivoted in with the hanging contour 27 at a middle groove 4' of the support profile 1', wherein the supporting part 21 protrudes between the sealing strips 3 on the support profile 1'. The hanging part 22 is mounted using the hooks 26 on the vertical support profile 1, and the hanging part 2 and the supporting part 21 are then screwed together, to ensure a stable support of the filling elements 5.

LIST OF REFERENCE NUMERALS 1, 1', 1" support profile
2 groove
3 sealing strip
4, 4', 4" groove
5 filling element
6 pressure strip
7 sealing strip
8 cover profile
9 insulation element
10 fastening means
11 head section
12 threaded section
13 nut
15 wall
15' wall
16 hollow chamber
20 glass carrier
21 support part
22 hanging part
23 screw
24 threaded section
25 groove base/wall
26 hook
27 suspension contour
28 slot
29 securing element
40 web
41 rib
42 groove base
43, 43' hollow chamber
44 web
45 groove wall
51 end section
52 recess
53 supporting surface
54 screw
55 opening
71 sealing lip
72 sealing lip
73 drip edge
90 arm
91 plastic web
92 filling material
93 projection

What is claimed is:

1. A mullion-transom assembly, comprising:

a support profile upon which two grooves are provided on an outer side;

a sealing strip affixed to each of the two grooves, a filling element held at an edge on each of the sealing strips, a middle groove disposed on the support profile between the two grooves and on which at least one fastening means for holding a pressure strip is fixed, to secure the two filling elements and the pressure strip, and at least one glass carrier that is hung or screwed on the middle groove, wherein the middle groove has groove walls, which are accommodated between the sealing strips and fixed respectively to the two grooves, wherein the pressure strip is arranged closer to a contact plane of the filling elements on the sealing strips than to groove walls of the middle groove, and wherein the middle groove has a groove base at which a hollow chamber is formed on a side facing away from the middle groove.

2. The mullion-transom assembly according to claim 1, wherein the support profile has a width less than 50 mm in a direction perpendicular to the longitudinal direction of the grooves on an outer side of the support profile.

3. The mullion-transom assembly according to claim 1, wherein the hollow chamber is adjacent to the groove base, and wherein the middle groove or the hollow chamber forms a drainage channel for discharging penetrating water.

4. A mullion-transom assembly, comprising:

a support profile upon which two grooves are provided on an outer side;

a sealing strip affixed to each of the two grooves, a filling element held at an edge on each of the sealing strips, and a middle groove disposed on the support profile between the two grooves and on which at least one fastening means for holding a pressure strip is fixed to secure the two filling elements and the pressure strip, wherein the middle groove has groove walls, which are accommodated between the sealing strips and fixed respectively to the two grooves, wherein the pressure strip is arranged closer to a contact plane of the filling elements on the sealing strips than to groove walls of the middle groove, wherein the middle groove has a groove base at which a hollow chamber is formed on a side facing away from the middle groove, and wherein at least one inwardly oriented web for guiding a groove block is provided in the hollow chamber.

5. A mullion-transom assembly, comprising:

a support profile upon which two grooves are provided on an outer side;

a sealing strip affixed to each of the two grooves, a filling element held at an edge on each of the sealing strips, and a middle groove disposed on the support profile between the two grooves and on which at least one fastening means for holding a pressure strip is fixed to secure the two filling elements and the pressure strip, wherein the middle groove has groove walls, which are accommodated between the sealing strips and fixed respectively to the two grooves, wherein the pressure strip is arranged closer to a contact plane of the filling elements on the sealing strips than to groove walls of the middle groove, wherein the middle groove has a groove base at which a hollow chamber is formed on a side facing away from the middle groove, and wherein a wall of the hollow chamber extends between two side walls of the support profile, said wall of the hollow chamber being parallel to and spaced apart from the groove base of the middle groove and wherein a screw for fixing a component penetrates the wall of the hollow chamber.

6. A mullion-transom assembly, comprising:

a support profile upon which two grooves are provided on an outer side;

a sealing strip affixed to each of the two grooves, a filling element held at an edge on each of the sealing strips, and a middle groove on which at least one fastening means for holding a pressure strip is fixed to secure the two filling elements and the pressure strip, wherein the middle groove has groove walls, which are accommodated between the sealing strips and fixed respectively to the two grooves, wherein the pressure strip is arranged closer to a contact plane of the filling elements on the sealing strips than to groove walls of the middle groove, wherein the middle groove has a groove base at which a hollow chamber is formed on a side facing away from the middle groove, and wherein at least one recess, in which a hook of a glass carrier is hung, is provided at the groove base of the middle groove.

7. The mullion-transom assembly according to claim 6, wherein the glass carrier has a vertically aligned hanging part having at least one hook and a horizontal support part, and wherein the vertically aligned hanging part and the horizontal support part are secured on one another.

8. The mullion-transom assembly according to claim 1, wherein a rib is formed on the groove base of the middle groove.

9. The mullion-transom assembly according to claim 1, wherein the support profile has a width that is greater than 50 mm, in a direction perpendicular to the longitudinal direction of the two grooves.

* * * * *